US012434168B2

(12) United States Patent
Askarov

(10) Patent No.: US 12,434,168 B2
(45) Date of Patent: Oct. 7, 2025

(54) SOAP BUBBLE-BLOWING CAP FOR A FLEXIBLE CONTAINER (VARIANTS)

(71) Applicant: Vladimir Vladimirovich Askarov, selo Zubovo (RU)

(72) Inventor: Vladimir Vladimirovich Askarov, selo Zubovo (RU)

( * ) Notice: Subject to any disclaimer, the term of this patent is extended or adjusted under 35 U.S.C. 154(b) by 345 days.

(21) Appl. No.: 18/025,225

(22) PCT Filed: Oct. 26, 2021

(86) PCT No.: PCT/RU2021/050354

§ 371 (c)(1),
(2) Date: Mar. 8, 2023

(87) PCT Pub. No.: WO2022/177462

PCT Pub. Date: Aug. 25, 2022

(65) Prior Publication Data

US 2023/0271100 A1 Aug. 31, 2023

(30) Foreign Application Priority Data

Feb. 17, 2021 (RU) ..... RU2021103985

(51) Int. Cl.
*A63H 33/28* (2006.01)
*A47K 5/12* (2006.01)

(52) U.S. Cl.
CPC ..... *A63H 33/28* (2013.01); *A47K 5/12* (2013.01)

(58) Field of Classification Search
CPC ..... A63H 33/28
See application file for complete search history.

(56) References Cited

U.S. PATENT DOCUMENTS 2,842,894 A * 7/1958 Walden ..... A63H 33/28 124/55
2,853,829 A * 9/1958 Greene ..... A63H 3/24 446/18
3,093,925 A * 6/1963 Greene ..... A63H 33/28 446/29
3,388,498 A * 6/1968 Greene ..... A63H 33/28 446/16
3,736,694 A * 6/1973 Lebensfeld ..... A63H 33/28 446/16
3,775,898 A * 12/1973 Kalish ..... A63H 33/28 446/17
3,925,923 A * 12/1975 La Fata ..... A63H 33/28 446/18
4,125,959 A * 11/1978 Markiw ..... A63H 33/28 446/17
4,423,565 A * 1/1984 Bart ..... A63H 33/28 446/16

(Continued)

FOREIGN PATENT DOCUMENTS

CN 210674233 U * 6/2020
GB 2224950 A * 5/1990 ..... A63H 33/28

(Continued)

*Primary Examiner* — Eugene L Kim
*Assistant Examiner* — Alyssa M Hylinski
(74) *Attorney, Agent, or Firm* — Nadya Reingand

(57) ABSTRACT

The invention relates to amusement devices for blowing soap bubbles and is intended for use, for example, when washing with shampoo contained in a flexible bottle having a cap configured to be capable of blowing soap bubbles.

12 Claims, 17 Drawing Sheets

(56) References Cited

U.S. PATENT DOCUMENTS

| | | | | | |
|---|---|---|---|---|---|
| 4,804,346 | A * | 2/1989 | Sheng | A63H 33/28 | 446/17 |
| 4,861,303 | A * | 8/1989 | Mong-Sheng | A63H 33/28 | 446/17 |
| 4,955,840 | A * | 9/1990 | Moomaw | A63H 33/28 | 446/17 |
| 4,995,844 | A * | 2/1991 | McNett | A63H 33/28 | 446/15 |
| 5,890,942 | A * | 4/1999 | Souza-Ferreira | A63H 33/28 | 446/268 |
| 6,905,386 | B2 * | 6/2005 | Thai | A63H 33/28 | 446/16 |
| 2009/0124161 | A1 * | 5/2009 | Barish | F41B 9/004 | 446/15 |

FOREIGN PATENT DOCUMENTS

| | | | | |
|---|---|---|---|---|
| WO | WO-2012002204 A1 * | 1/2012 | | B05B 11/026 |
| WO | WO-2017117323 A1 * | 7/2017 | | A63H 33/28 |

* cited by examiner

SOAP BUBBLE-BLOWING CAP FOR A FLEXIBLE CONTAINER (VARIANTS)

FIELD OF INVENTION

The purported inventions relate to amusement devices for blowing soap bubbles and are intended for use, for example, when washing with shampoo (a detergent, hereinafter—shampoo) in a flexible bottle having a cap configured to blow soap bubbles.

BACKGROUND

A known soap bubble blowing device contains a stylized housing with a liquid soap container and a compressed air source with an outlet channel, at least one diaphragm, mounted in the housing and able to be moved through a drive and placed in the liquid soap container and opposite the outlet channel. The compressed air source may be equipped with an air flow speed changing device, which may be in the form of a damper. The diaphragm and the damper may work synchronously (patent of Russian Federation No 2019244, A63H 33/28 dated Sep. 15, 1994).

The disadvantage of the aforesaid device is its design complexity, including the use of a special unit to change air flow speed, such as a damper.

The closest to the claimed devices in terms of the combination of essential features and the result achieved is a soap bubble formation device containing: a liquid soap container; a loop to be moved inside the said container to a position below the fluid level or withdrawn from the said fluid, and a controlled system of compressed gas supply into the said container through an expanding chamber in which a spring pushes the piston to its lower position, and the compressed gas (air) in the chamber being pumped into the expanding chamber expands, causing the piston to move upward until its radial holes line up with the slot on the inner surface of the cylinder therein the piston is moving. When this occurs, air is forced out of the center hole of the piston through an air nozzle in the upper surface of the piston, where the above-mentioned loop, therethrough the soap bubble is blown as the loop is withdrawn from the fluid by the piston moving upward, is installed. The system for supplying compressed gas to said container through the expandable chamber can be manually operated (U.S. Pat. No. 9,050,543 A63H 33/28 dated Jun. 9, 2015—a prototype).

The disadvantage of the prototype device is its complexity and the intricacy of its application, associated, in particular, with the presence of a spring, which pushes an operating element—the piston—to its lower position; to compress the spring and move the operating element—the piston up into the sub-piston space—the expandable chamber—pre-compressed gas (air) is pumped; the compressed gas supply system can be controlled manually, for example, in the manner similar to the type of pressure control in a blood pressure monitor cuff; however, even such system of compressed gas supply from a separate compressed gas storage unit in order to actuate the device is still intricate. Thus, the complexity of the device and its application does not allow it to be used for amusement in everyday life, e.g., when bathing children.

SUMMARY

The problem to be solved and the technical result of the claimed embodiments of the invention lie in the creation of bubble blowing devices easy to make and to use for amusement in everyday life, for example, when bathing children; either piston-actuated (device embodiments one and two) or flexible membrane—actuated (device embodiments three and four) in the stopper of the flexible container by manual squeezing of the latter and due to the drive-actuated lever system connected with the piston or the flexible membrane—the system combining a bubble blowing ring with a nozzle when squeezing the flexible container and moving the ring into the soap solution after blowing a soap bubble and stopping squeezing; without using a compressed gas storage unit.

The application task is solved by four bubble blowing device embodiments proposed.

The first embodiment: A soap bubble blowing device consisting of a cavity for a soap solution and a diaphragm to be periodically placed in the soap solution and connected to a piston driven by manual squeezing of the compressed gas, whereas the improvement consists in a soap bubble blowing cap for a flexible container , in the plug of which there is a shampoo dispenser channel leading to the cavity for soap solution and an air channel with a piston installed therein and driven by manual squeezing of the flexible container and connected to the ring as a diaphragm through a lever system, thereat the wall of the air channel is furnished with an opening connecting the air channel to the nozzle through an air duct, and the lever system may align the ring with the said nozzle.

The lever system is a guide with a ring fixed at one end, and the opposite end being connected to an axis tightly fixed in the body of the cap, such guide able to perform rotational oscillations respective to the said axis within the limits determined by the distance between the upper and the lower piston movement restrictors set above each other on the outer surface of the piston, thereat an inner surface of the air channel has a groove corresponding to the said restrictors.

Additionally, the plug is equipped with a channel for supplying shampoo from a flexible container for hygienic procedures, or a dispenser channel may also supply shampoo from a flexible container for hygienic procedures.

The second embodiment: A soap bubble blowing device, comprising a cavity for soap solution and a diaphragm to be periodically placed in the soap solution and connected to a piston driven by manual squeezing of the compressed gas, whereas the improvement consists in a soap bubble blowing cap for a flexible container , in the plug of which there is a shampoo dispensing channel leading to the soap solution cavity and an air channel with a piston installed therein and actuated by manually squeezing of the flexible container and connected to a ring as a diaphragm through a lever system, thereat the cap has a preferably L-shaped air duct used for connecting air space under the cap with the nozzle, and the lever system may align the ring with the said nozzle.

The lever system is a guide with a ring fixed at one end, and the opposite end being connected to an axis tightly fixed in cap body, such guide able to perform rotational oscillations respective to the said axis within the limits determined by the distance between the upper and the lower piston movement restrictors set above each other on the outer surface of the piston, thereat an inner surface of the air channel has a groove corresponding to the said restrictors.

Additionally, the plug is equipped with a channel for supplying shampoo from a flexible container for hygienic procedures, or a dispenser channel may also supply shampoo from a flexible container for hygienic procedures.

The third embodiment: A soap bubble blowing device comprising a soap solution cavity and a diaphragm to be periodically placed in the soap solution and connected to an operating element driven by manual squeezing of the compressed gas, whereas the improvement consists in a soap bubble blowing cap for a flexible container , in the plug of which there is a shampoo dispenser channel leading to the cavity for soap solution and an air channel with an operating element—a flexible membrane, overlapping its cross section, actuated by manual squeezing of the flexible container and connected to the ring as a diaphragm through a lever system, thereat the wall of the air channel is furnished with an opening connecting the air channel to the nozzle through an air duct, and the lever system may align the ring with the said nozzle.

The lever system is a guide with a ring fixed at one end, and the opposite end being connected to an axis tightly fixed in the cap body, such guide able to perform rotational oscillations respective to the said axis being actuated by manual squeezing of a flexible container.

Additionally, the plug is equipped with a channel for supplying shampoo from a flexible container for hygienic procedures, or a dispenser channel may also supply shampoo from a flexible container for hygienic procedures.

The fourth embodiment: A soap bubble blowing device comprising a soap solution cavity and a diaphragm to be periodically placed in the soap solution and connected to an operating element driven by manual squeezing of the compressed gas, whereas the improvement consists in a soap bubble blowing cap for a flexible container, in the plug of which there is a shampoo dispenser channel leading to the cavity for soap solution and an air channel with an operating element—a flexible membrane, overlapping its cross section, actuated by manual squeezing of the flexible container and connected to the ring as a diaphragm through a lever system, thereat the cap has preferably an L-shaped duct for connecting air space under the cap with the nozzle, and the lever system is designed to align the ring with the said nozzle.

The lever system is a guide with a ring fixed at one end, and the opposite end being connected to an axis tightly fixed in the cap body, such guide able to perform rotational oscillations respective to the said axis being actuated by manual squeezing of a flexible container.

Additionally, the plug is equipped with a channel for supplying shampoo from a flexible container for hygienic procedures, or a dispenser channel may also supply shampoo from a flexible container for hygienic procedures.

The flexible membrane covering the section of the air channel (device embodiments three and four) can be made, for example, of a material used in household or medical gloves production (latex, rubber, etc.) in the form of a folded (possibly concertinaed) flexible flap unfolded with moving down or up; or in the form of a "glove finger" sagging under atmospheric pressure conditions or occupying upper (working) position under compressed air pressure. Obviously, the depth of downward movement or sagging of the flexible membrane in "initial position" of the device and correspondingly the height of its location in the air channel in the working condition (and partially the material extensibility of the flexible membrane) determine the limits of rotational oscillations of the guiding drive-actuated lever system relative to the fixed axis in the cap body induced by manual squeezing of the flexible container.

The preferably L-shaped duct mentioned in two of the four claimed embodiments may actually have any shape. Thus, the duct in the form of a flexible tube is clearly more convenient in case that the claimed devices are equipped not with a single-lever drive system (prescribed in the dependent claims of the claimed inventions), but with a double-lever one, which is as operable as a single-lever system.

For all embodiments of the claimed cap, it is obviously necessary to use an air channel with an operating element (a piston or a flexible membrane) placed therein wider than in an air duct in order to provide the required operating sequence of all device embodiments: in case of pressure increase in the space under the plug caused by squeezing the flexible container, the increased pressure firstly effects on the operating element in the air channel and then the air is blown out through the air duct.

Diameters of the shampoo dispenser channel in all cap embodiments and those of the channel of shampoo delivery for hygienic procedures (in case that the dependent claims provide for the availability of such delivery channel in the claimed devices) must be similar to the air duct diameter.

Due to manual squeezing, increased air pressure occurs inside the flexible container, and the compressed air presses evenly on the entire internal surface of the container. The force with which the compressed air presses the inner surface of the container is equal to the manual compression force adjusted for air compression and the container deformation force intensification. The compressed air tends to leave the container with the least resistance; this means that first of all the compressed air will be replaced to the widest air duct, moving the piston or the flexible membrane placed in it to the extreme upper position (the gravity force acting on the piston (membrane) is negligible due to low mass of the piston (membrane) compared to the compressed air pressure force), and only then the compressed air will go out (release) through the duct, the dispenser channel and the channel of shampoo delivery for hygienic procedures, the said channels having a smaller diameter compared to that of the air duct. Besides, the air duct, the dispenser channel and the channel of shampoo delivery for hygienic procedures may be equipped with valves to maintain increased pressure of compressed air in the container until the piston (diaphragm) moves to the extreme upper position and, respectively, for subsequent excess pressure release outside. However, in practice, the models of the claimed device embodiments prove their operability even without valves.

BRIEF DESCRIPTION OF THE DRAWINGS

The claimed soap bubble blowing cap for a flexible container consists of a plug itself closing the neck of the flexible container, and a cavity for soap solution. Embodiments of the claimed cap are schematically shown in FIGS. 1-17, including:

The figures show.

Figure 1:
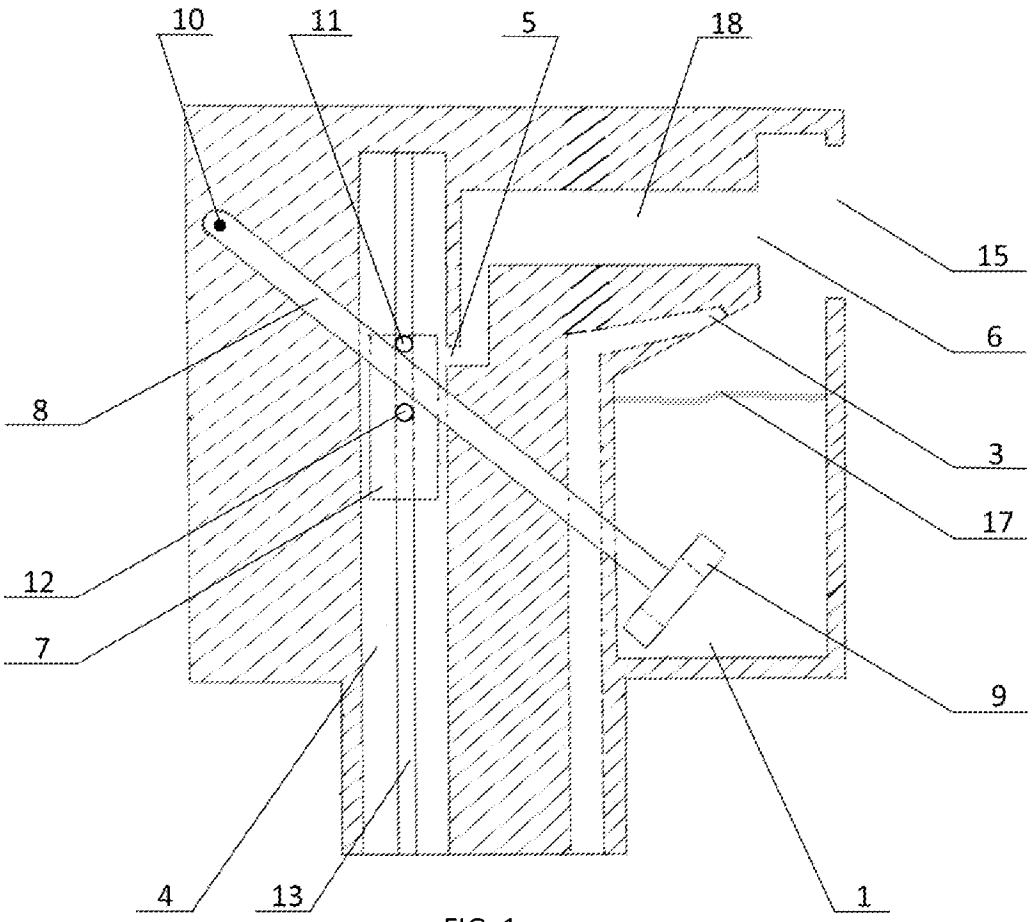
FIGS. 1-4 refer to the first embodiment (claims 1-3)

1—a soap solution cavity;

2—a channel for shampoo (detergent, hereinafter—shampoo) delivery from the flexible container to be used as intended (for hygienic procedures), located in the plug;

3—a dispenser channel for shampoo delivery to soap solution cavity 1;

4—an air duct used to supply air to/from the flexible container; located in the plug;

5—an opening in the wall of the air duct 4;

6—a nozzle connected (depending on the device embodiment) to the opening 5 or to the air space under the plug by the air outlet 18 passing inside the claimed cap;

7—a piston moving in the air duct 4;

8—a guide (the lever system element);

9—a ring for blowing bubbles;

10—an axis fixed in the cap body;

11—an upper piston movement limiter 7;

12—a lower piston movement limiter 7;

13—a groove made on the inner wall of the air duct 4;

14—a flexible membrane;

15—an opening in the claimed cap of the flexible container necessary to blow formed bubbles out of cavity 1;

16—an outlet of channel 2 or the dispenser channel 3, if any, providing extra opportunity to supply shampoo from the flexible container in order to carry out hygienic procedures;

17—a soap solution level in cavity 1;

18—an air outlet.

The fixed axis 10 fixes, among other things, the height of the horizontal position of guide 8;

When piston 7 (the first and the second embodiments of the device) moves up and down in air duct 4, guide 8 performs rotational oscillations relative to axis 10 being simultaneously replaced between piston 7 movement limiters: the upper limiter 11 and the lower limiter 12 within the distance between them, for periodic alignment of ring 9 with nozzle 6;

When membrane 14 (the third and fourth embodiments of the device) moves up and down in air duct 4, the guide 8 performs rotational oscillations relative to axis 10 for periodic alignment of ring 9 with nozzle 6.

DETAILED DESCRIPTION OF THE PREFERRED EMBODIMENTS

The devices work as follows:

Operation of the First Device Embodiment—FIGS. 1-4

1. Turn the flexible container upside down and squeeze shampoo out of it through the dispenser channel 3 into cavity 1. Shampoo dosage to cavity 1 may be adjusted by changing the diameter of dispenser channel 3.
2. Return the flexible container to the bottom down position, draw water into cavity 1 through the cap opening 15 and shake the container to get a soap solution.
3. Bring the device to the "initial position" (FIG. 1) when the pressure inside the flexible container and in the air duct 4 of the claimed cap corresponds to the atmospheric pressure, as the flexible container is connected to the atmosphere, in particular, through a gap between piston 7 and the wall of the air duct 4. The position of the piston 7 in the air duct 4 is the lowest position in which opening 5 in the wall of the air duct 4 connected by air outlet 18 with nozzle 6 is closed by piston 7. At the indicated position of piston 7, the guide 8 is in an inclined position and is supported from above by the upper limiter 11 of piston 7 movement and leads the ring 9 to the position under level 17 of the soap solution.
4. Squeeze the flexible container, thus removing the air therefrom to air duct 4, correspondingly increasing the pressure in the sub-piston volume. Under the action of increased pressure, the piston 7 is gradually moving upwards along the air duct 4.

As the piston 7 is moving to the highest position, the lever system (guide 8, one end thereof is connected to the fixed axis 10) leads the ring 9 to a position above the soap solution level 17 and further until it is aligned with nozzle 6. Thereat, guide 8, at one end connected to the fixed axis 10, while its other end is moving with ring 9 from the soap solution (FIG. 1) to the horizontal position (FIG. 2) is simultaneously displaced between the upper piston movement limiter 11 and lower piston movement limiter 12, such displacement being induced by guide 8 rotating counterclockwise relative to axis 10.

At the same time opening 5 in the wall of the air duct 4 connected by air outlet 18 to nozzle 6 (FIG. 2) is opened. Affected by pressure in the sub-piston space increased by squeezing the flexible container, air is moving from the flexible container to the air duct 4 and further through the opening 5 into the duct 18 to nozzle 6, thereat ring 9 with soap film is aligned. Under the pressure of the air supplied from the squeezed flexible container, a soap bubble is blown out through ring 9.

Figure 2:
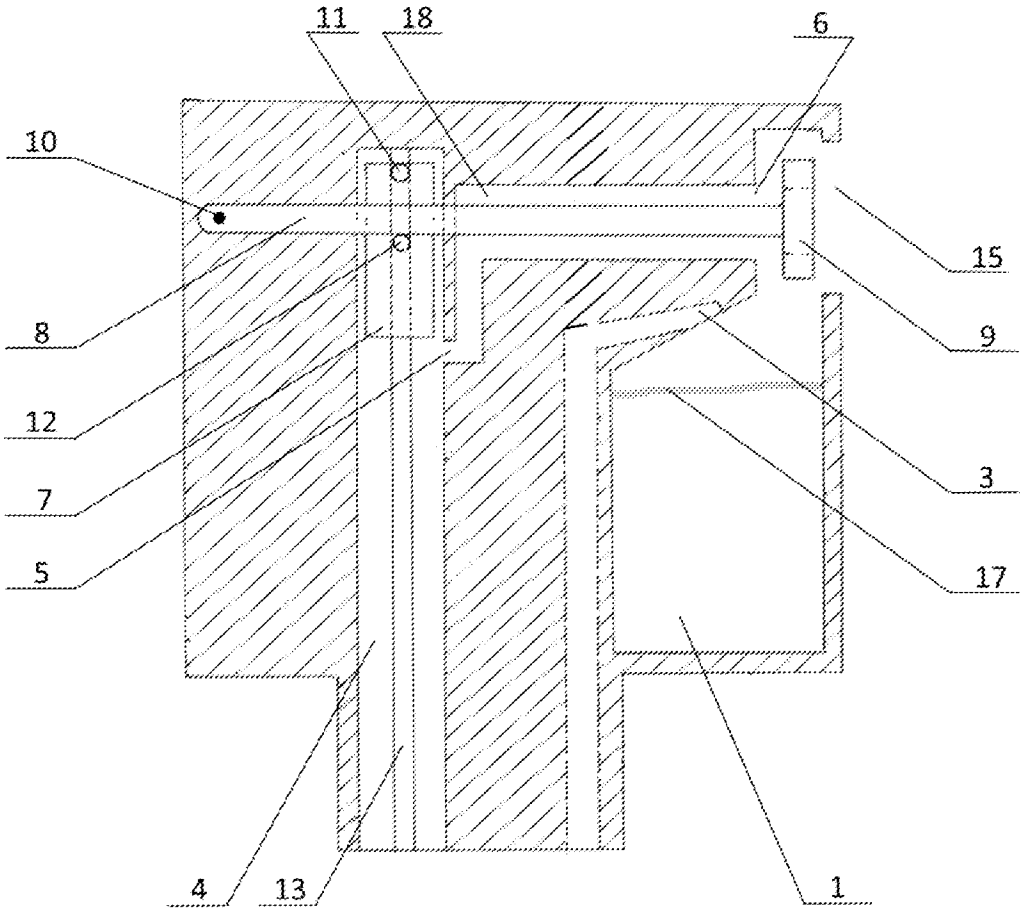

5. Stop squeezing the flexible container. Due to its elasticity it tends to regain its original shape, as a result of which the sub-piston volume is increased, and the air atmosphere under piston 7 is accordingly becoming less dense. Piston 7 also affected by gravity is advancing downwards along the air duct 4. The depth of the piston 7 downward movement is limited by the distance between the upper piston movement limiter 11 and lower piston movement limiter 12, between which the guide 8 is rotating clockwise relative to the axis 10 from the horizontal position to an inclined position shown in FIG. 1, when the ring 9 is immersed in the cavity 1 under the soap solution level 17, and piston 7, in its turn, is fixed in the lowest position, closing the opening 5 in air duct 4 (FIG. 1—"initial position" of the device).
6. Squeeze the flexible container moving piston 7 from the lowest position (FIG. 1—"initial position" of the device) to the highest position (FIG. 2) by air pressure in the sub-piston space, and further as described above in step 4 of the device operation sequence: air flows from the flexible container into the air duct 4 and then through opening 5 into the air outlet 18 to nozzle 6, therewith ring 9 with soap film is aligned. Under the pressure of the air supplied from the squeezed flexible container, a soap bubble is blown out through the ring 9 (FIG. 2).

Having brought the device in the "initial position" (FIG. 1), repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the first embodiment of the proposed device according to claims 1-2 of the claimed invention is operated by periodically squeezing the flexible container.

The first embodiment of the device according to claim 3 of the claimed invention —when channel 2 for shampoo delivery from the flexible container for hygienic procedures is located in the plug (FIG. 3), or when the dispenser channel 3 provides an extra option to supply shampoo from a flexible container for hygienic procedures (FIG. 4)—is operated in the following sequence:

1. Turning the flexible container upside down in order to use shampoo as intended, that is, for hygienic procedures, squeeze the shampoo out of the flexible container through channel 2 (FIG. 3); at the same time the shampoo is partially flowing into cavity 1 along the dispenser channel 3. Shampoo dosage into cavity 1 may be adjusted by changing the diameter of the dispenser channel 3.

Or—in case that the dispenser channel 3 provides an extra option to supply shampoo from a flexible container for hygienic procedures (FIG. 4)—squeeze the shampoo from a flexible container through the dispenser channel 3 both for hygienic purposes and for making soap solution in cavity 1. Shampoo dosage into cavity 1 may be adjusted by changing the diameter of the dispenser channel 3.

2. Return the flexible container to the bottom down position, draw water into cavity 1 through the cap opening 15 and shake the container to get a soap solution.
3. Bring the device to the "initial position" (FIG. 1) when the pressure inside the flexible container and in the air duct 4 of the claimed cap corresponds to the atmospheric pressure, as the flexible container is connected to the atmosphere, in particular, through a gap between piston 7 and the wall of the air duct 4, as well as through the shampoo delivery channel 2 and through the dispensing channel 3 of the claimed cap. The position of the piston 7 in the air duct 4 is the lowest, thereat opening 5 in the wall of the air duct 4 connected by air outlet 18 with nozzle 6 is closed by piston 7. At the indicated position of piston 7, the guide 8 is in an inclined position and is supported from above by the upper limiter 11 of piston 7 movement and leads the ring 9 to the position under level 17 of the soap solution (not shown in the figures, but similar to FIG. 1).
4. The flexible container is squeezed, thus removing the air therefrom to air duct 4, and correspondingly increasing the pressure in the sub-piston volume. Under the action of the increased pressure, piston 7 is gradually moving upwards along the air duct 4.

As piston 7 is moving to the highest position, the lever system (guide 8, one end thereof is connected to the fixed axis 10) leads the ring 9 to a position above the soap solution level 17 and further until it is aligned with nozzle 6. Thereat, guide 8, at one end connected to the fixed axis 10, is simultaneously displaced between the upper piston movement limiter 11 and lower piston movement limiter 12 while its other end is moving with ring 9 from the soap solution to the horizontal position (FIG. 3, FIG. 4), such displacement being induced by guide 8 rotating counterclockwise relative to axis 10.

Figure 3:
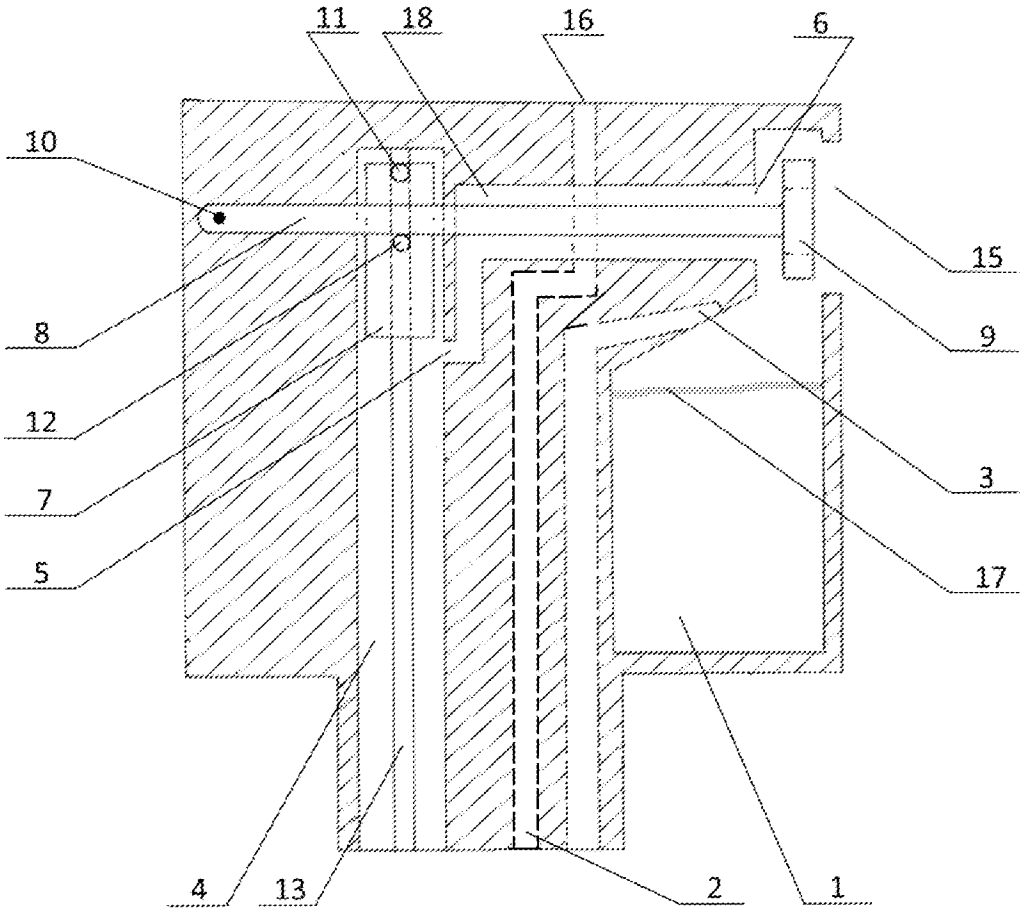
Figure 4:
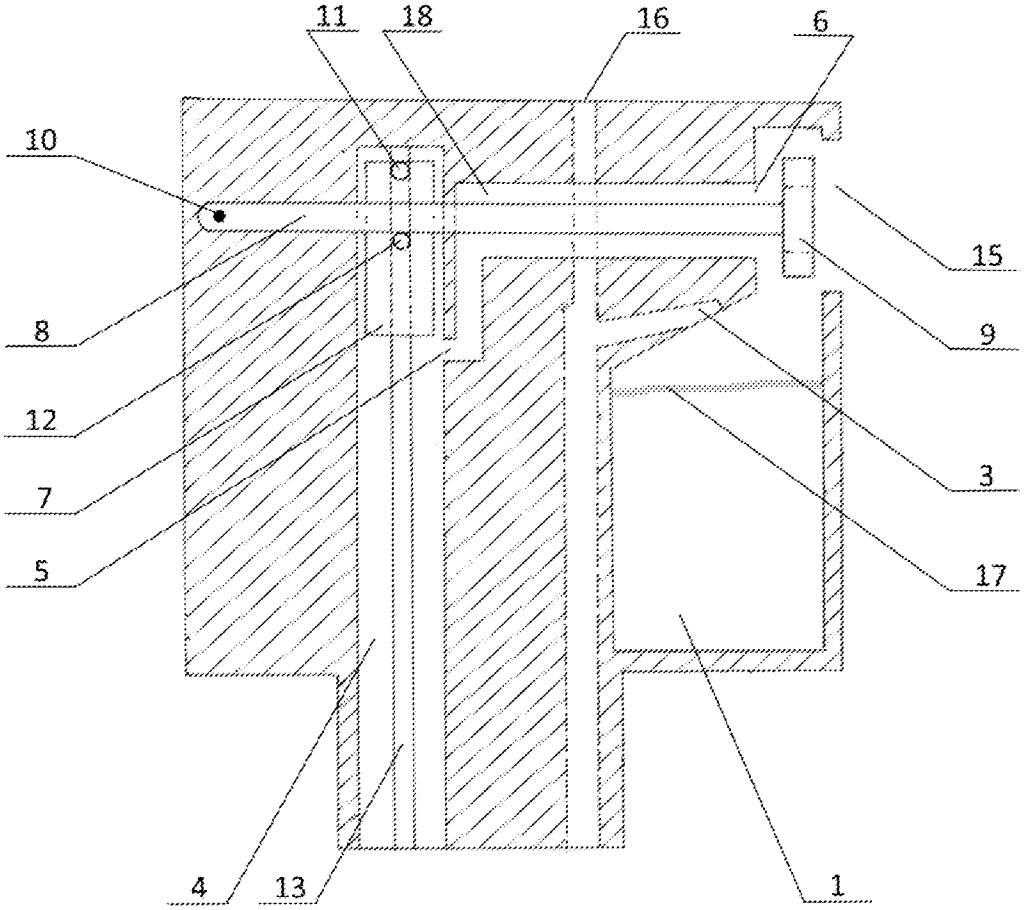

At the same time opening 5 in the wall of the air duct 4 connected by air outlet 18 to nozzle 6 (FIG. 3, FIG. 4) is opened. Affected by pressure in the sub-piston space increased by squeezing the flexible container, air is moving from the flexible container to the air duct 4 and further through opening 5 into the air outlet 18 to nozzle 6, thereat ring 9 with soap film is aligned (FIG. 3, FIG. 4). Under the pressure of the air supplied from the squeezed flexible container, a soap bubble is blown out through ring 9.

5. Stop squeezing the flexible container. Due to its elasticity it tends to regain its original shape, as a result of which the sub-piston volume is increased, and the air atmosphere under piston 7 is accordingly becoming less dense. Piston 7 also affected by gravity is advancing downwards along the air duct 4. Thereat, the depth of piston 7 downward movement is limited by the distance between the upper piston 7 movement limiter 11 and lower piston 7 movement limiter 12, between which the guide 8 is rotating clockwise relative to the axis 10 from the horizontal position to an inclined position (similar to that shown in FIG. 1), when ring 9 is immersed into cavity 1 under the soap solution level 17, and piston 7, in its turn, is fixed in the lowest position, closing the opening 5 in air duct 4 ("initial position" of the device).
6. The flexible container is squeezed by moving piston 7 from the lowest position (from the "initial position" of the device) to the highest position (FIG. 3, FIG. 4) and by air pressure in the sub-piston space, and further as described above in step 4 of the device operation sequence: air flows from the flexible container into the air duct 4 and then through opening 5 into the air outlet 18 to nozzle 6, therewith ring 9 with soap film is aligned (FIG. 3, FIG. 4). Under the pressure of the air supplied from the squeezed flexible container, a soap bubble is blown out through ring 9.

Having brought the device in the "initial position" again, repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the first embodiment of the proposed device according to claim 3 of the claimed invention is operated by periodically squeezing the flexible container.

Operation of the Second Device Embodiment—FIGS. 5-8

1. Turn the flexible container upside down and squeeze shampoo out of it through the dispenser channel 3 into cavity 1. Shampoo dosage to cavity 1 may be adjusted by changing the diameter of dispenser channel 3.
2. Return the flexible container to the bottom down position, draw water into cavity 1 through the cap opening 15 and shake the container to get a soap solution.
3. Bring the device to the "initial position" (FIG. 6) when the pressure inside the flexible container and in the air duct 4 of the claimed cap corresponds to the atmospheric pressure, as the flexible container is connected to the atmosphere, in particular, through a gap between piston 7 and the wall of the air duct 4, as well as through air outlet 18 and the dispenser channel 3. The position of the piston 7 in the air duct 4 is the lowest position in which guide 8 is in an inclined position and is supported from above by the upper limiter 11 of piston 7 movement and leads the ring 9 to the position under level 17 of the soap solution (FIG. 6).
4. The flexible container is squeezed, thus removing the air therefrom to air duct 4, and correspondingly increasing the pressure in the sub-piston volume. Under the action of the increased pressure, piston 7 is gradually moving upwards along the air duct 4.

As the piston 7 is moving to the highest position, the lever system (guide 8, one end thereof is connected to the fixed axis 10) leads the ring 9 to a position above the soap solution level 17 and further until it is aligned with nozzle 6. Thereat, guide 8, at one end connected to the fixed axis 10, while its other end is moving with ring 9 from the soap solution (FIG. 6) to the horizontal position (FIG. 5) is simultaneously displaced between the upper movement limiter 11 and lower movement limiter 12 of piston 7, such displacement being induced by guide 8 rotating counterclockwise relative to axis 10.

Figure 5:
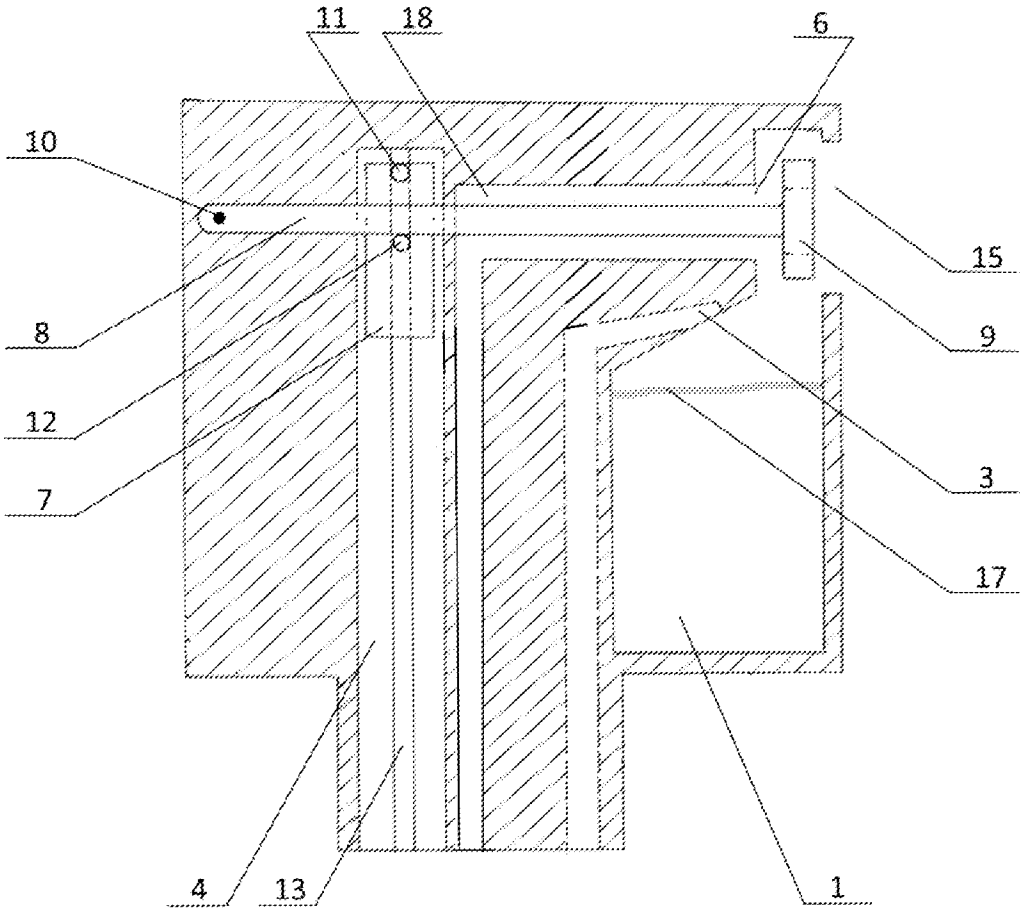
FIGS. 5-8 refer to the second embodiment (claims 4-6)
Figure 6:
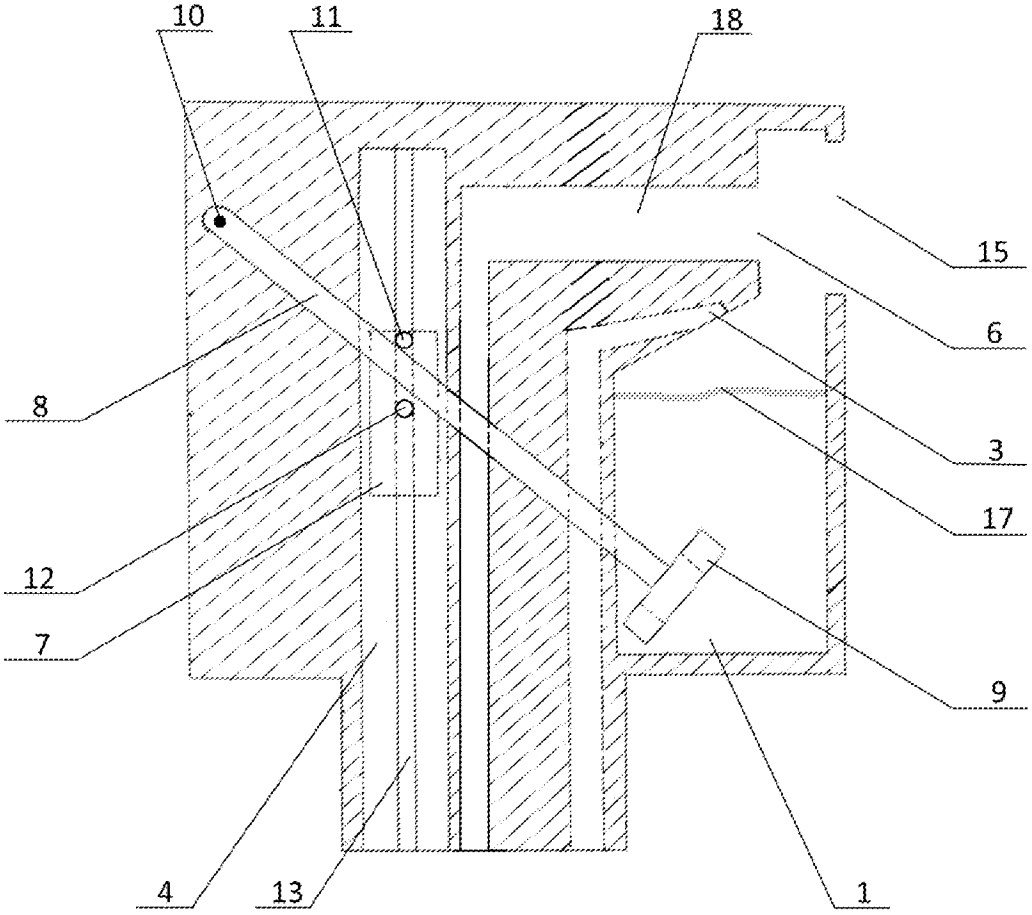

At the same time, under the action of increased pressure in the sub-piston space caused by squeezing the flexible container, air moves from the flexible container to the air outlet 18 into nozzle 6, with which the ring 9 with the soap film is combined. Affected by pressure in the sub-piston space increased by squeezing the flexible container, air is moving from the flexible container to the air outlet 18 into nozzle 6 thereto ring 9 with soap film is aligned. Under the pressure of the air supplied from the squeezed flexible container through air outlet 18, a soap bubble is blown out through ring 9 (FIG. 5).

5. Stop squeezing the flexible container. Due to its elasticity it tends to regain its original shape, as a result of which the sub-piston volume is increased, and the air atmosphere under piston 7 is accordingly becoming less dense. Piston 7 also affected by gravity is advancing downwards along the air duct 4. The depth of the piston 7 downward movement is limited by the distance between the upper movement limiter 11 and lower movement limiter 12 of piston 7, between which the guide 8 is rotating clockwise relative to the axis 10 from the horizontal position (FIG. 5) to an inclined position shown in FIG. 6, when the ring 9 is immersed into cavity 1 under the soap solution level 17, and piston 7, in its turn, is fixed in the lowest position (FIG. 6—"initial position" of the device).
6. Squeeze the flexible container moving piston 7 from the lowest position (FIG. 6—"initial position" of the device) to the highest position (FIG. 5) by air pressure in the sub-piston space, and further as described above in step 4 of the device operation sequence: air flows from the flexible container into the air outlet 18 and then to nozzle 6, therewith ring 9 with soap film is aligned (FIG. 5). Under the pressure of the air supplied from the squeezed flexible container through air duct 18, a soap bubble is blown out through the ring 9 (FIG. 5).

Having brought the device in the "initial position" (FIG. 6), repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the second embodiment of the proposed device according to claims 4-5 of the claimed invention is operated by periodically squeezing the flexible container.

The second embodiment of the device according to claim 6 of the claimed invention—when channel 2 for shampoo delivery from the flexible container for hygienic procedures is located in the plug (FIG. 8), or when the dispenser channel 3 provides an extra option to supply shampoo from a flexible container for hygienic procedures (FIG. 7)—is operated in the following sequence:

1. Turning the flexible container upside down in order to use shampoo as intended, that is, for hygienic procedures, squeeze the shampoo out of the flexible container through channel 2 (FIG. 8); at the same time the shampoo is partially flowing into cavity 1 along the dispenser channel 3. Shampoo dosage into cavity 1 may be adjusted by changing the diameter of the dispenser channel 3.

Or—in case that the dispenser channel 3 provides an extra option to supply shampoo from a flexible container for hygienic procedures (FIG. 7)—squeeze the shampoo from a flexible container through the dispenser channel 3 both for hygienic purposes and for making soap solution in cavity 1. Shampoo dosage into cavity 1 may be adjusted by changing the diameter of the dispenser channel 3.

2. Return the flexible container to the bottom down position, draw water into cavity 1 through the cap opening 15 and shake the container to get a soap solution.
3. Bring the device to the "initial position" when the pressure inside the flexible container and in the air duct 4 of the claimed cap corresponds to the atmospheric pressure, as the flexible container is connected to the atmosphere, in particular, through a gap between piston 7 and the wall of the air duct 4, as well as through the shampoo delivery channel 2 and through the dispensing channel 3 of the claimed cap. The position of the piston 7 in the air duct 4 is the lowest, thereat the guide 8 is in an inclined position and is supported from above by the upper limiter 11 of piston 7 movement and leads the ring 9 to the position under level 17 of the soap solution (not shown in the figures, but similar to FIG. 6).
4. The flexible container is squeezed, thus removing the air therefrom to air duct 4, and correspondingly increasing the pressure in the sub-piston volume. Under the action of the increased pressure, piston 7 is gradually moving upwards along the air duct 4.

As piston 7 is moving to the highest position, the lever system (guide 8, one end thereof is connected to the fixed axis 10) leads the ring 9 to a position above the soap solution level 17 and further until it is aligned with nozzle 6. Thereat, guide 8, at one end connected to the fixed axis 10, is simultaneously displaced between the upper movement limiter 11 and the lower movement limiter 12 of piston 7 while its other end is moving with ring 9 of the soap solution to the horizontal position (FIG. 7, FIG. 8), such displacement being induced by guide 8 rotating counterclockwise relative to axis 10.

Figure 7:
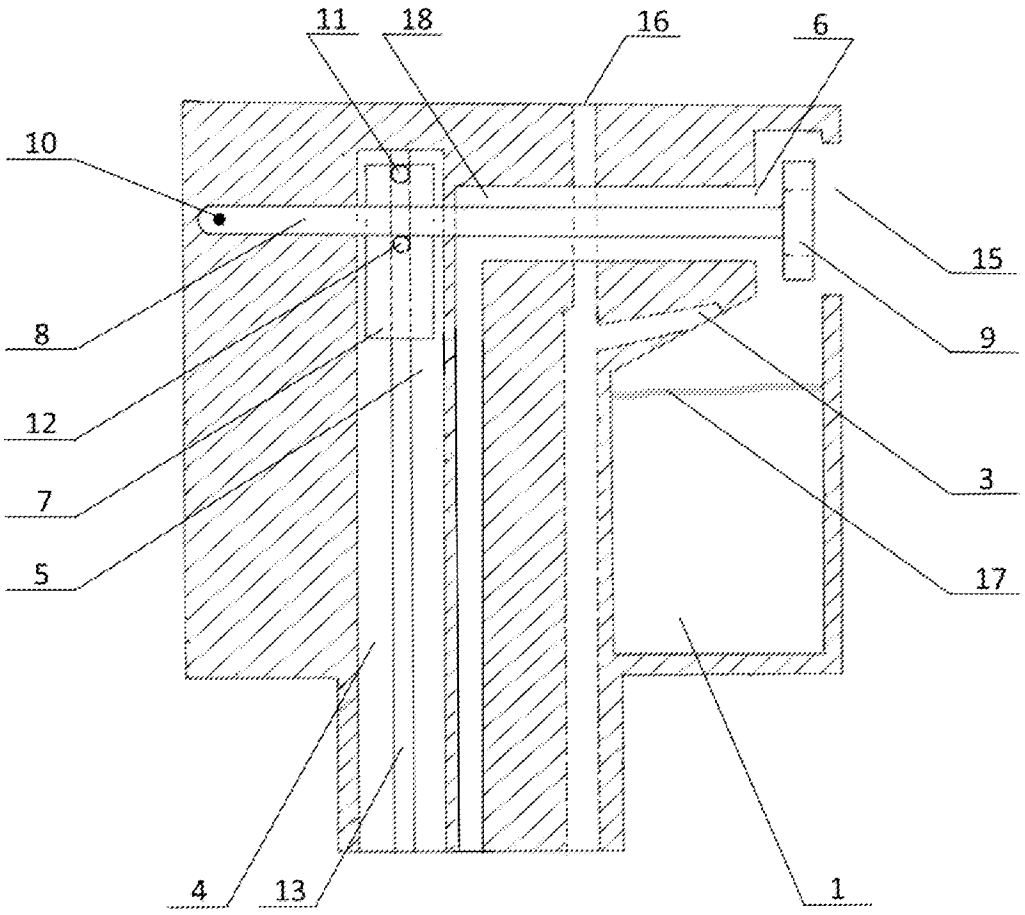
Figure 8:
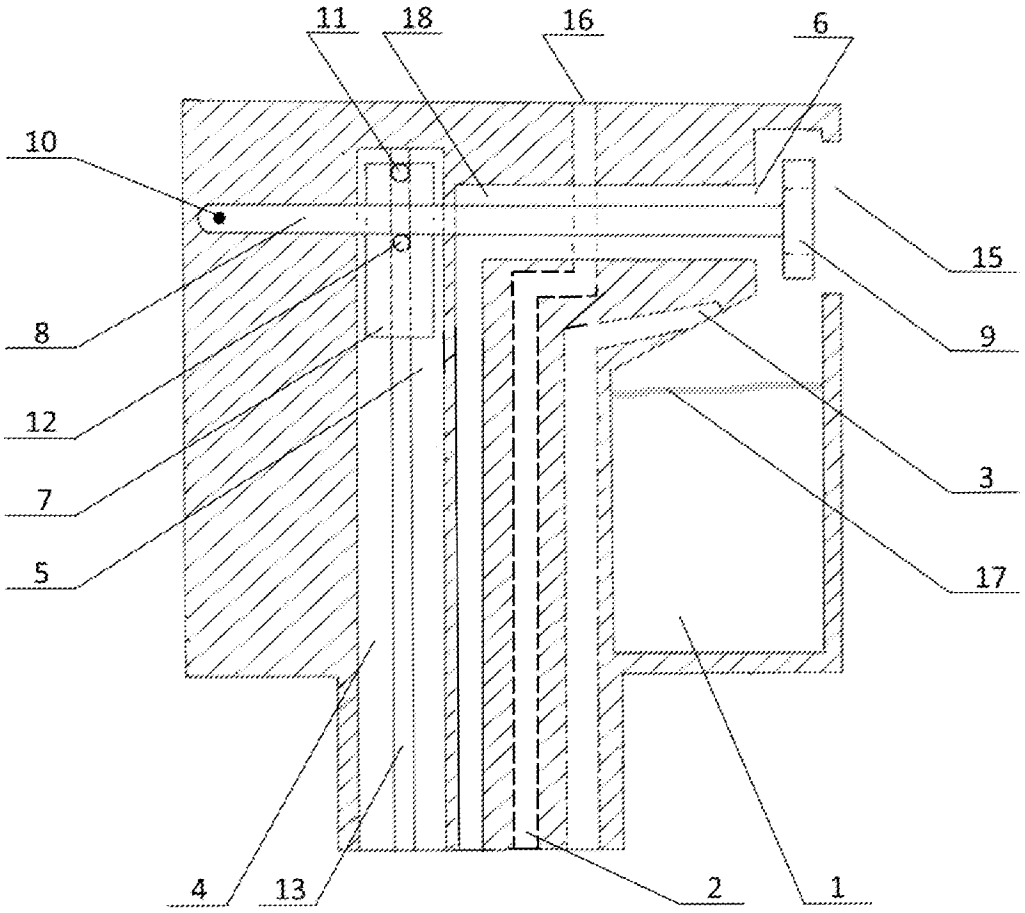
Figure 9:
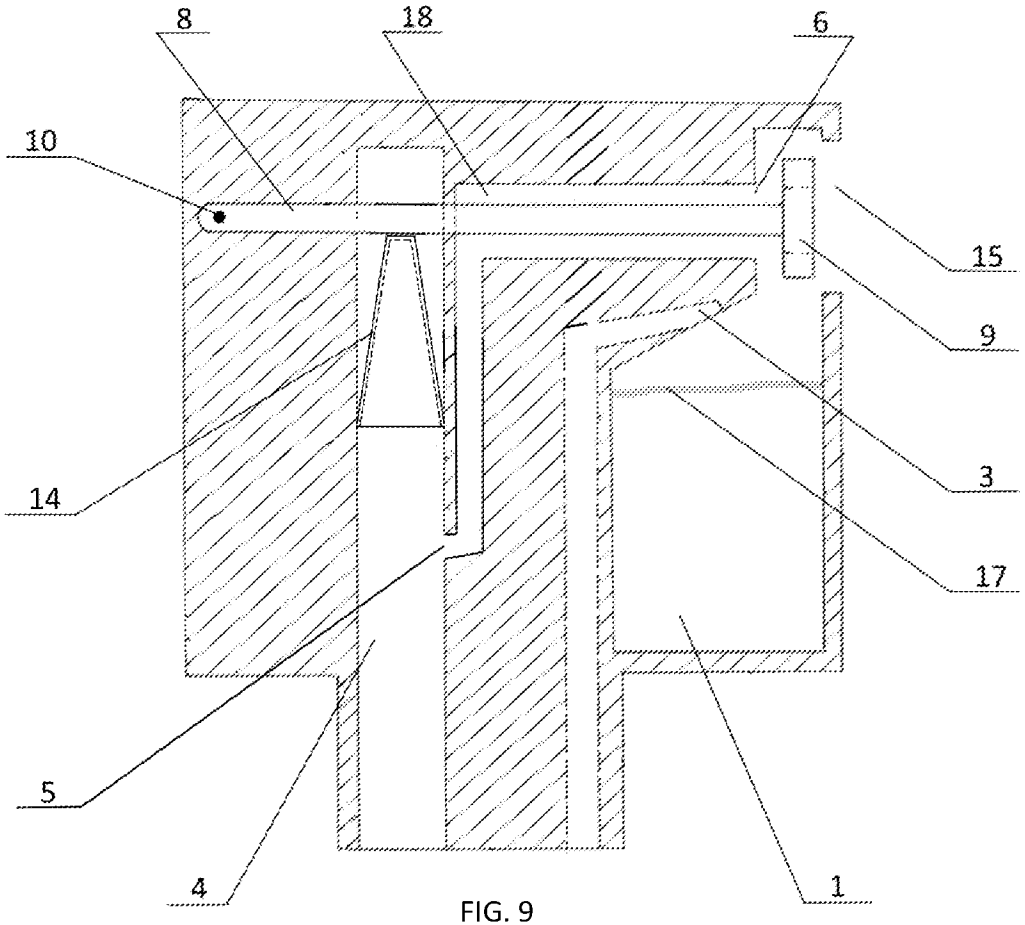
FIGS. 9-12 refer to the third embodiment (claims 7-9)

At the same time, affected by pressure under the plug increased by squeezing the flexible container, and, accordingly, under the pressure of the air supplied from the squeezed flexible container through air outlet 18 and further to nozzle 6, a soap bubble is blown out through ring 9 combined with nozzle 6 (FIG. 7, FIG. 8).

5. Stop squeezing the flexible container. Due to its elasticity it tends to regain its original shape, as a result of which the sub-piston volume is increased, and the air atmosphere under piston 7 is accordingly becoming less dense. Piston 7 also affected by gravity is advancing downwards along the air duct 4. Thereat, the depth of piston 7 downward movement is limited by the distance between the upper piston 7 movement limiter 11 and lower piston 7 movement limiter 12, between which the guide 8 is rotating clockwise relative to the axis 10 from the horizontal position (FIG. 7, FIG. 8) to an inclined position (similar to that shown in FIG. 6), when ring 9 is immersed into cavity 1 under the soap solution level 17, and piston 7, in its turn, is fixed in the lowest position ("initial position" of the device).
6. Squeeze the flexible container moving piston 7 from the lowest position (from the "initial position" of the device) to the highest position (FIG. 7, FIG. 8) by air pressure in the sub-piston space, and further as described above in step 4 of the device operation sequence: air flows from the flexible container into the air outlet 18 and then to nozzle 6, therewith ring 9 with soap film is aligned (FIG. 7, FIG. 8). Under the pressure of the air supplied from the squeezed flexible container through air duct 18, a soap bubble is blown out through the ring 9.

Having brought the device in the "initial position" again, repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the second embodiment of the proposed device according to claim 6 of the claimed invention is operated by periodically squeezing the flexible container.

Operation of the Third Device Embodiment—FIGS. 9-12

1. Turn the flexible container upside down and squeeze shampoo out of it through the dispenser channel 3 into cavity 1. Shampoo dosage to cavity 1 may be adjusted by changing the diameter of dispenser channel 3.
2. Return the flexible container to the bottom down position, draw water into cavity 1 through the cap opening 15 and shake the container to get a soap solution.
3. Bring the device to the "initial position" (FIG. 10) when the pressure inside the flexible container and in the air duct 4 of the claimed cap corresponds to the atmospheric pressure, as the flexible container is connected to the atmosphere, in particular, through opening 5 in the wall of the air duct 4 connected through air outlet 18 to nozzle 6. In the "initial position" of the device (FIG. 10) the flexible membrane 14 covers the section of duct 4 and is in sagging position; and guide 8 is in an inclined position and leads ring 9 to the position under level 17 of the soap solution.
4. The flexible container is squeezed, thus removing the air therefrom to air duct 4, and correspondingly increasing the pressure under the flexible membrane 14. Under the action of the increased pressure, the flexible membrane 14 is replaced from the lowest—sagging-condition to the highest—operating condition, moving upwards along the air duct 4.

As the flexible membrane 14 is replaced to the highest—operating condition (FIG. 9), the lever system (guide 8, one end thereof is connected to the fixed axis 10 and supported at the bottom by the membrane 14 having replaced to the operating condition) leads ring 9 to a position above the soap solution level 17 and further until it is aligned with nozzle 6. Thereat, guide 8, at one end connected to the fixed axis 10, is displaced from the inclined position (FIG. 10) to the horizontal position (FIG. 9), such displacement being induced by guide 8 rotating counterclockwise relative to axis 10.

Then, affected by pressure in the sub-membrane space increased by squeezing the flexible container, air is moving from the flexible container to the air duct 4 and further through opening 5 into air outlet 18 to nozzle 6 thereto ring 9 with soap film is aligned. Under the pressure of the air supplied from the squeezed flexible container through air outlet 18, a soap bubble is blown out through ring 9.

Figure 10:
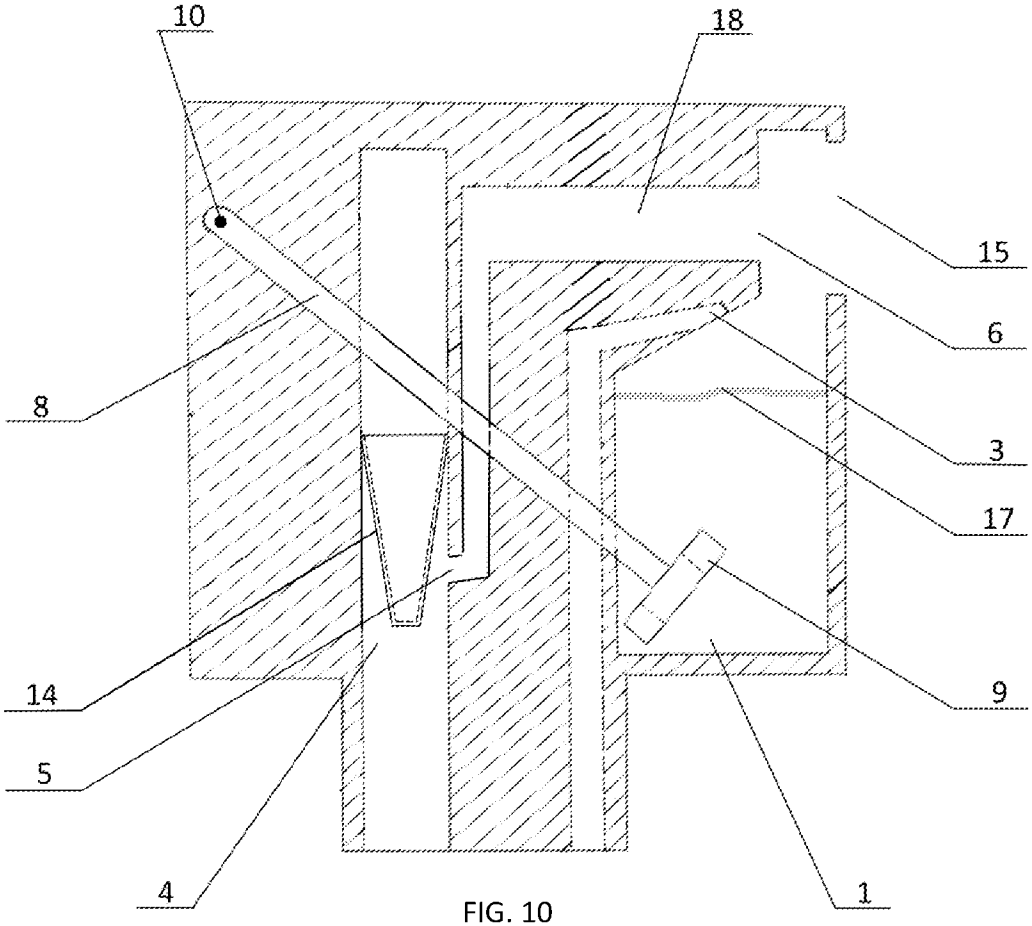

5. Stop squeezing the flexible container. Due to its elasticity it tends to regain its original shape, as a result of which the sub-membrane air volume is pulled into the flexible vessel, and membrane 14 also affected by gravity is advancing downwards along the air duct 4 and is coining to a sagging condition (FIG. 10). As a result, while rotating clockwise relative to the axis 10 guide 8 comes from the horizontal position (FIG. 9) to an inclined position (FIG. 10), when the ring 9 is immersed into cavity 1 under the soap solution level 17—and the device returns to the "initial position".
6. Squeeze the flexible container by moving membrane 14 in the sub-membrane space by air pressure from the lowest—sagging-position (FIG. 10—"initial position" of the device) to the highest position (FIG. 9), and further as described above in step 4 of the device operation sequence: affected by pressure in the sub-membrane space increased due to squeezing the flexible container, air flows from the flexible container into the air duct 4 further through opening 5 into air outlet 18 to nozzle 6 thereto ring 9 with soap film is aligned. Under the pressure of the air supplied from the squeezed flexible container, a soap bubble is blown out through the ring 9 (FIG. 5).

Having brought the device in the "initial position" (FIG. 10), repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the third embodiment of the proposed device according to claims 7-8 of the claimed invention is operated by periodically squeezing the flexible container.

The third embodiment of the device according to claim 9 of the claimed invention—when channel 2 for shampoo delivery from the flexible container for hygienic procedures is located in the plug (FIG. 11), or when the dispenser channel 3 provides an extra option to supply shampoo from a flexible container for hygienic procedures (FIG. 12)—is operated in the following sequence:

1. Turning the flexible container upside down in order to use shampoo as intended, that is, for hygienic procedures, squeeze the shampoo out of the flexible container through channel 2 (FIG. 11); at the same time the shampoo is partially flowing into cavity 1 along the dispenser channel 3. Shampoo dosage into cavity 1 may be adjusted by changing the diameter of the dispenser channel 3.

Or—in case that the dispenser channel 3 provides an extra option to supply shampoo from a flexible container for hygienic procedures (FIG. 12)—squeeze the shampoo from a flexible container through the dispenser channel 3 both for hygienic purposes and for making soap solution in cavity 1. Shampoo dosage into cavity 1 may be adjusted by changing the diameter of the dispenser channel 3.

2. Return the flexible container to the bottom down position, draw water into cavity 1 through the cap opening 15 and shake the container to get a soap solution.
3. Bring the device to the "initial position" when the pressure inside the flexible container and in the air duct 4 of the claimed cap corresponds to the atmospheric pressure, as the flexible container is connected to the atmosphere, in particular, through opening 5 in the wall of the air duct 4, as well as through the shampoo delivery channel 2 and through the dispensing channel 3 of the claimed cap. The position of membrane 14 in the air duct 4 is the lowest—sagging. In the said position of membrane 14 the guide 8 is in an inclined position and leads the ring 9 to the position under level 17 of the soap solution (not shown in the figures, but similar to FIG. 10).

4. The flexible container is squeezed, thus removing the air therefrom to air duct 4, and correspondingly increasing the pressure in the sub-membrane volume. Under the action of the increased pressure, membrane 14 is replaced from the lowest—sagging-position upwards along air duct 4 and comes to the highest—operating condition (FIG. 11, FIG. 12).

Figure 11:
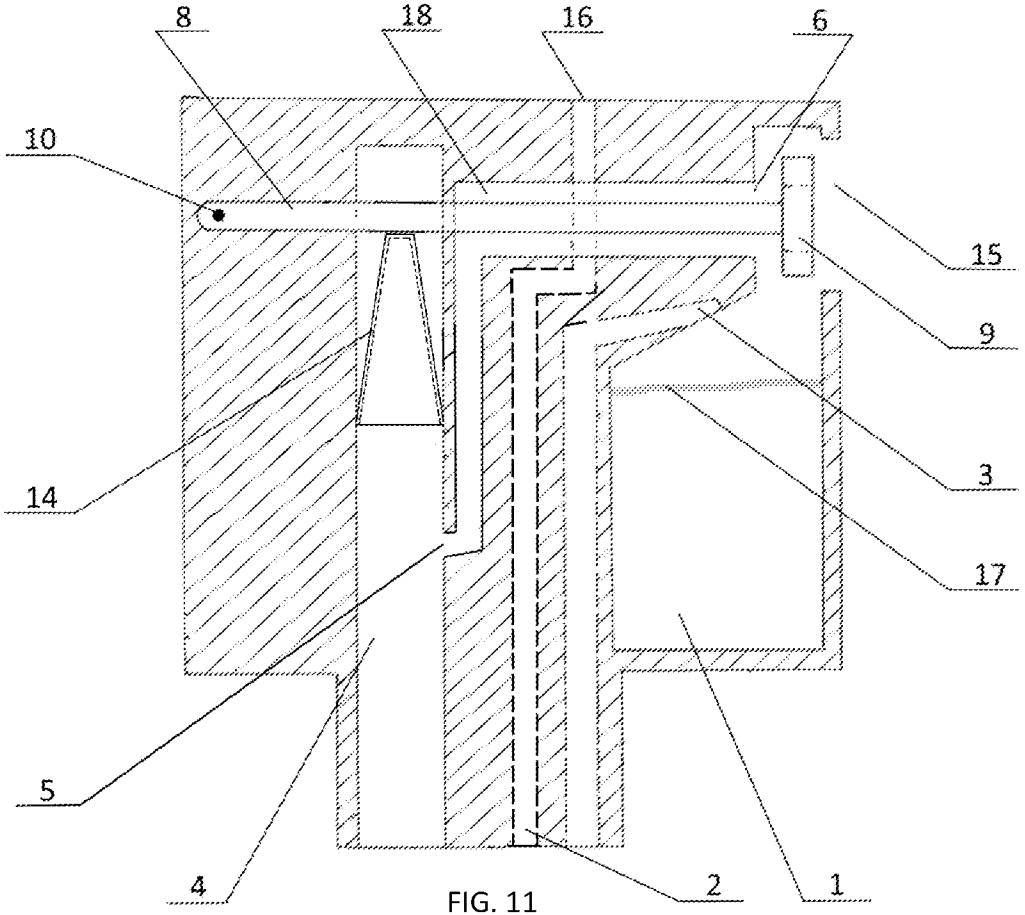
Figure 12:
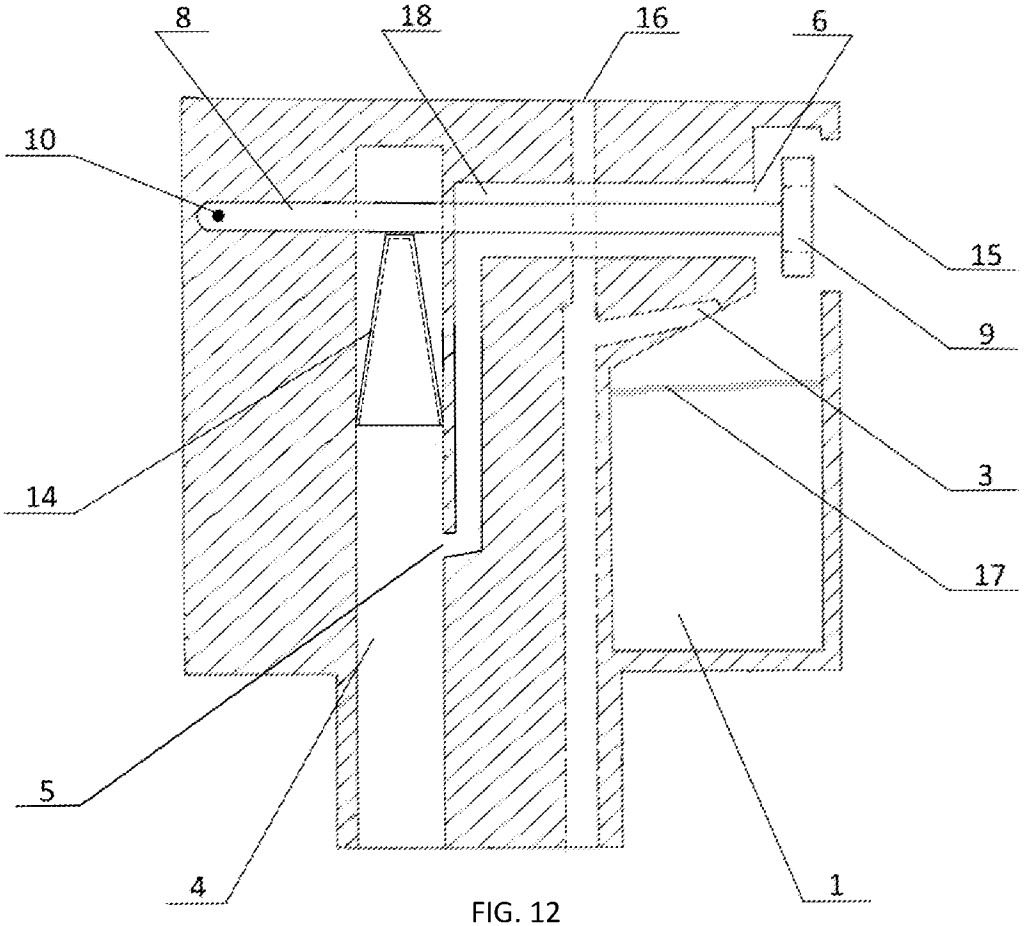

Thereat, guide 8, supported from below by membrane 14 having come to the operating condition is replacing from the inclined position to the horizontal one (FIG. 11, FIG. 12), such displacement being induced by guide 8 rotating counterclockwise relative to axis 10; thus, ring 9 is aligned with nozzle 6 (FIG. 11, FIG. 12). Under the action of pressure in the sub-membrane space increased due to squeezing the flexible container, air is further replaced from the flexible container to the air duct 4 and then through opening 5 to air outlet 18 to nozzle 6 therewith ring 9 with soap film is aligned. Under the pressure of the air supplied from the squeezed flexible container through air outlet 18, a soap bubble is blown out through ring 9 (FIG. 11, FIG. 12).

5. Stop squeezing the flexible container. Due to its elasticity it tends to regain its original shape, as a result of which the sub-membrane air volume is pulled into the flexible vessel, and membrane 14 also affected by gravity is advancing downwards along the air duct 4 and is coining to a sagging condition (similar to FIG. 10). As a result, while rotating clockwise relative to the axis 10 guide 8 comes from the horizontal position (FIG. 11, FIG. 12) to an inclined position (similar to FIG. 10), when the ring 9 is immersed into cavity 1 under the soap solution level 17—and the device returns to the "initial position".
6. Squeeze the flexible container by moving membrane 14 in the sub-membrane space by air pressure from the lowest—sagging-position to the highest position (FIG. 11, FIG. 12), and further as described above in step 4 of the device operation sequence: affected by pressure in the sub-membrane space increased due to squeezing the flexible container, air flows from the flexible container into the air duct 4 further through opening 5 into air outlet 18 to nozzle 6 thereto ring 9 with soap film is aligned. Under the pressure of the air supplied from the squeezed flexible container, a soap bubble is blown out through the ring 9 (FIG. 11, FIG. 12).

Having brought the device in the "initial position" (similar to FIG. 10), repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the third embodiment of the proposed device according to claim 9 of the claimed invention is operated by periodically squeezing the flexible container.

Operation of the Fourth Device Embodiment—FIG. 13-16

1. Turn the flexible container upside down and squeeze shampoo out of it through the dispenser channel 3 into cavity 1. Shampoo dosage to cavity 1 may be adjusted by changing the diameter of dispenser channel 3.
2. Return the flexible container to the bottom down position, draw water into cavity 1 through the cap opening 15 and shake the container to get a soap solution.
3. Bring the device to the "initial position" (FIG. 14) when the pressure inside the flexible container and in the air duct 4 of the claimed cap corresponds to the atmospheric pressure, as the flexible container is connected to the atmosphere, in particular, through air outlet 18 and the dispenser channel 3. The position of the flexible membrane 14 in the air duct 4 is the lowest—sagging, thereat guide 8 is in an inclined position and leads ring 9 to the position under level 17 of the soap solution (FIG. 14).
4. The flexible container is squeezed, thus removing the air therefrom to air duct 4, and correspondingly increasing the pressure in the sub-membrane space. Under the action of the increased pressure, the flexible membrane 14 is moving upwards along the air duct 4 from the lowest—sagging-condition to the highest—operating condition (FIG. 13).

Figure 13:
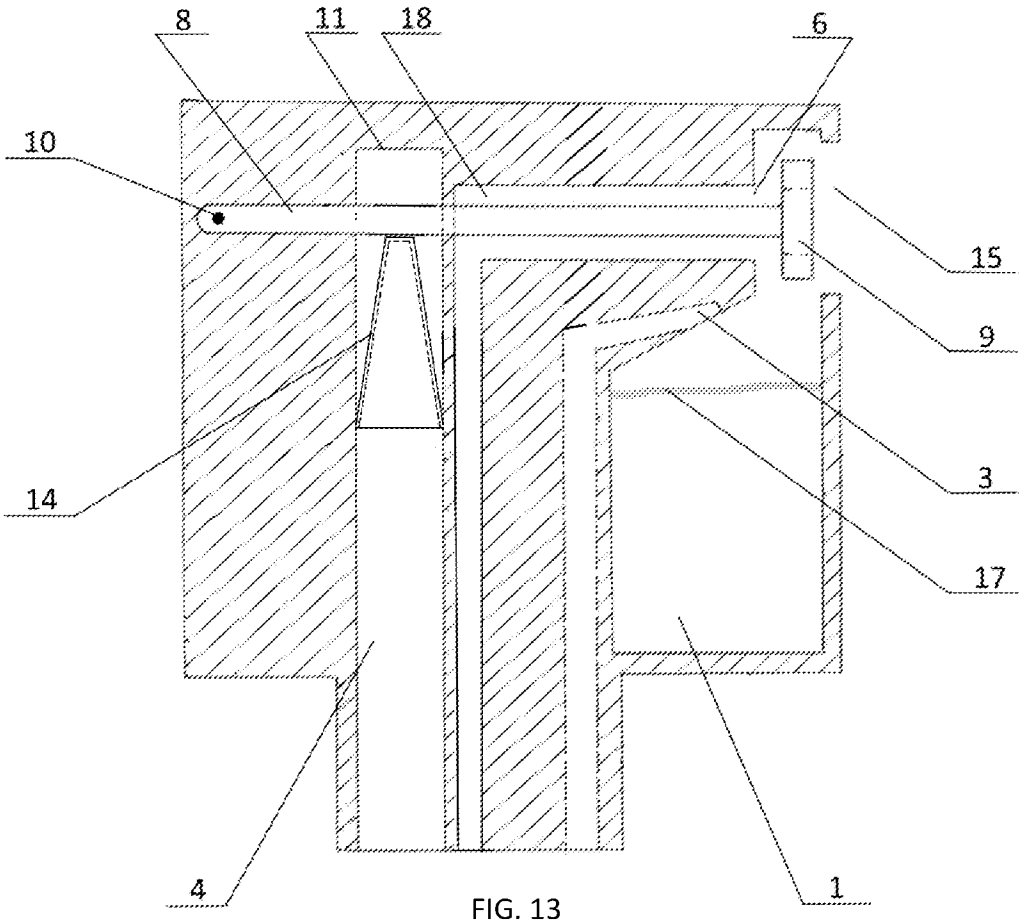
FIGS. 13-16 refer to the fourth embodiment (claims 10-12)

Thereat, guide 8, one end thereof is connected to the fixed axis 10 supported by membrane 14 in the operating condition is replaced from the inclined position to the horizontal one, such displacement being induced by guide 8 rotating counterclockwise relative to axis 10 and brings ring 9 to the position above level 17 of soap solution and further until it is aligned with nozzle 6 (FIG. 13).

At the same time, affected by pressure increased by squeezing the flexible container, air is moving from the flexible container into the air outlet 18 to nozzle 6 thereto ring 9 with soap film is aligned. Under the pressure of the air supplied from the squeezed flexible container through air outlet 18, a soap bubble is blown out through ring 9 (FIG. 13).

Figure 14:
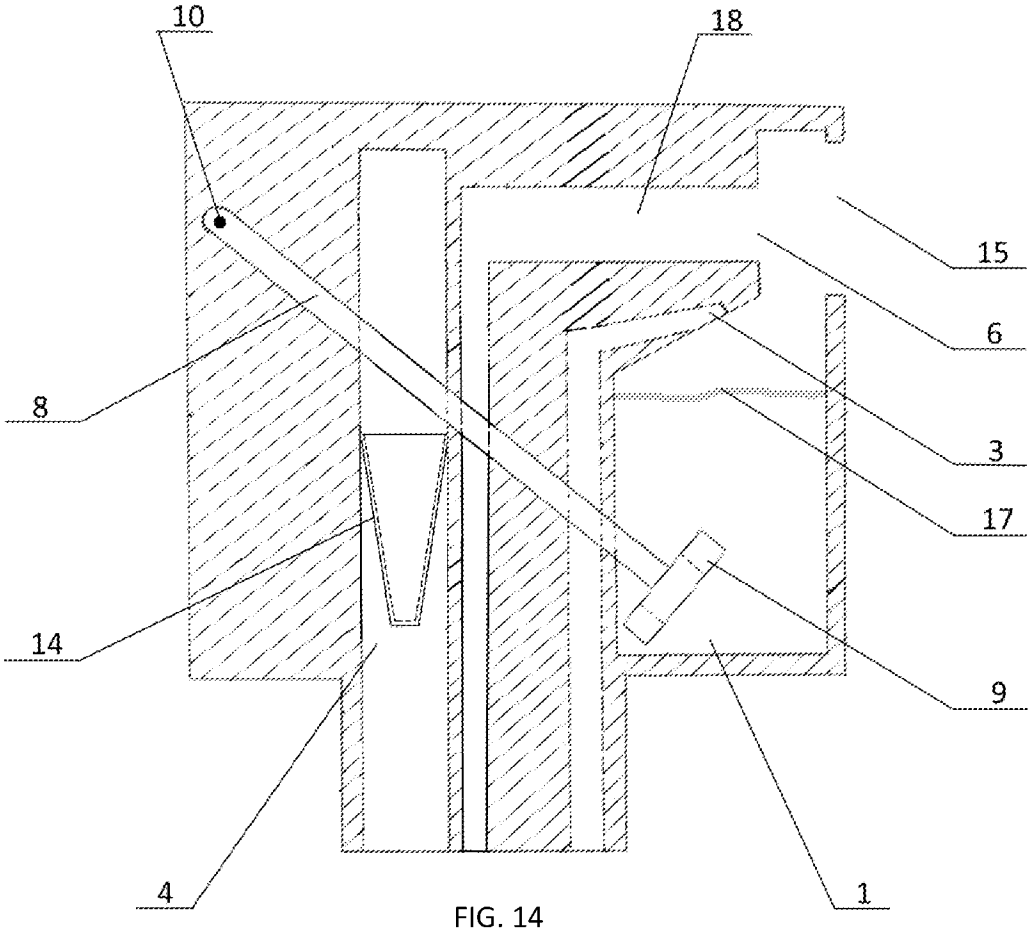

5. Stop squeezing the flexible container. Due to its elasticity it tends to regain its original shape, as a result of which the sub-membrane air volume is pulled into the flexible vessel, and membrane 14 also affected by gravity is advancing downwards along the air duct 4 and is coining to a sagging condition (FIG. 14). As a result, while rotating clockwise relative to the axis 10, guide 8 comes from the horizontal position (FIG. 13) to an inclined position (FIG. 14), when the ring 9 is immersed into cavity 1 under the soap solution level 17—and the device returns to the "initial position".
6. Squeeze the flexible container by moving membrane 14 in the sub-membrane space by air pressure from the lowest—sagging-position to the highest—operating position (FIG. 13). Further affected by pressure in the sub-membrane space increased due to squeezing the flexible container, air flows from the flexible container into the air outlet 18 to nozzle 6 thereto ring 9 with soap film is aligned. Under the pressure of the air supplied from the squeezed flexible container along air outlet 18, a soap bubble is blown out through the ring 9 (FIG. 13).

Having brought the device in the "initial position" (FIG. 14), repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the fourth embodiment of the proposed device according to claims 10-11 of the claimed invention is operated by periodically squeezing the flexible container.

The fourth embodiment of the device according to claim 12 of the claimed invention—when an extra channel 2 for shampoo delivery from the flexible container for hygienic procedures is located in the plug (FIG. 15), or when the dispenser channel 3 provides an extra option to supply shampoo from a flexible container for hygienic procedures (FIG. 16)—is operated in the following sequence:

1. Turning the flexible container upside down, squeeze the shampoo out of the flexible container through the dispenser channel 3 to cavity 1 and at the same time along channel 2 or the dispenser channel 3—to the container cap surface (position 16 on FIG. 17) for hygienic procedures. Shampoo dosage into cavity 1 may be adjusted by changing the diameter of the dispenser channel 3.
2. Return the flexible container to the bottom down position, draw water into cavity 1 through the cap opening 15 and shake the container to get a soap solution.
3. Bring the device to the "initial position" (similar to FIG. 14) when the pressure inside the flexible container and in the air duct 4 of the claimed cap corresponds to the atmospheric pressure, as the flexible container is connected to the atmosphere, in particular, through air outlet 18, as well as through the shampoo delivery channel 2 and through the dispensing channel 3. The position of membrane 14 in the air duct 4 is the lowest—sagging. In the said position of membrane 14 the guide 8 is in an inclined position and leads the ring 9 to the position under level 17 of the soap solution (similar to FIG. 14).
4. The flexible container is squeezed, thus removing the air therefrom to air duct 4, and correspondingly increasing the pressure in the sub-membrane space. Under the action of the increased pressure, membrane 14 is replaced from the lowest—sagging-position upwards along air duct 4 and comes to the highest—operating condition (FIG. 15, FIG. 16).

Figure 15:
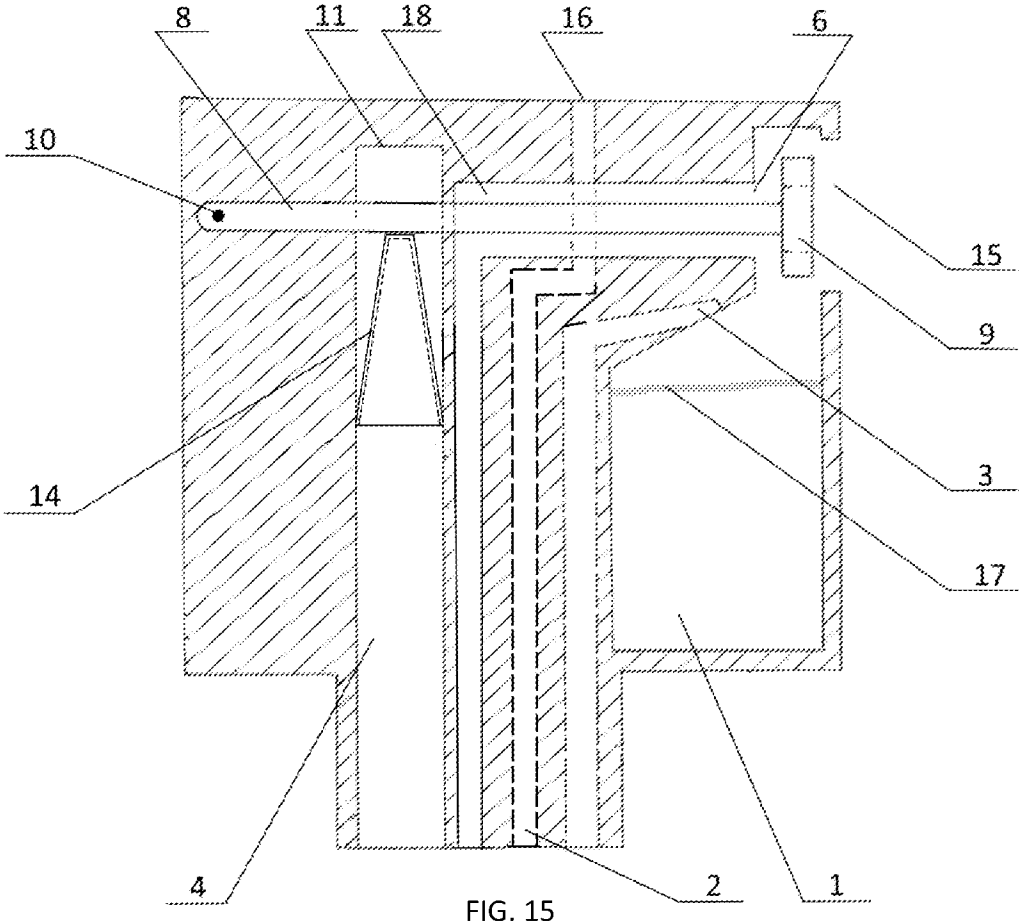
Figure 16:
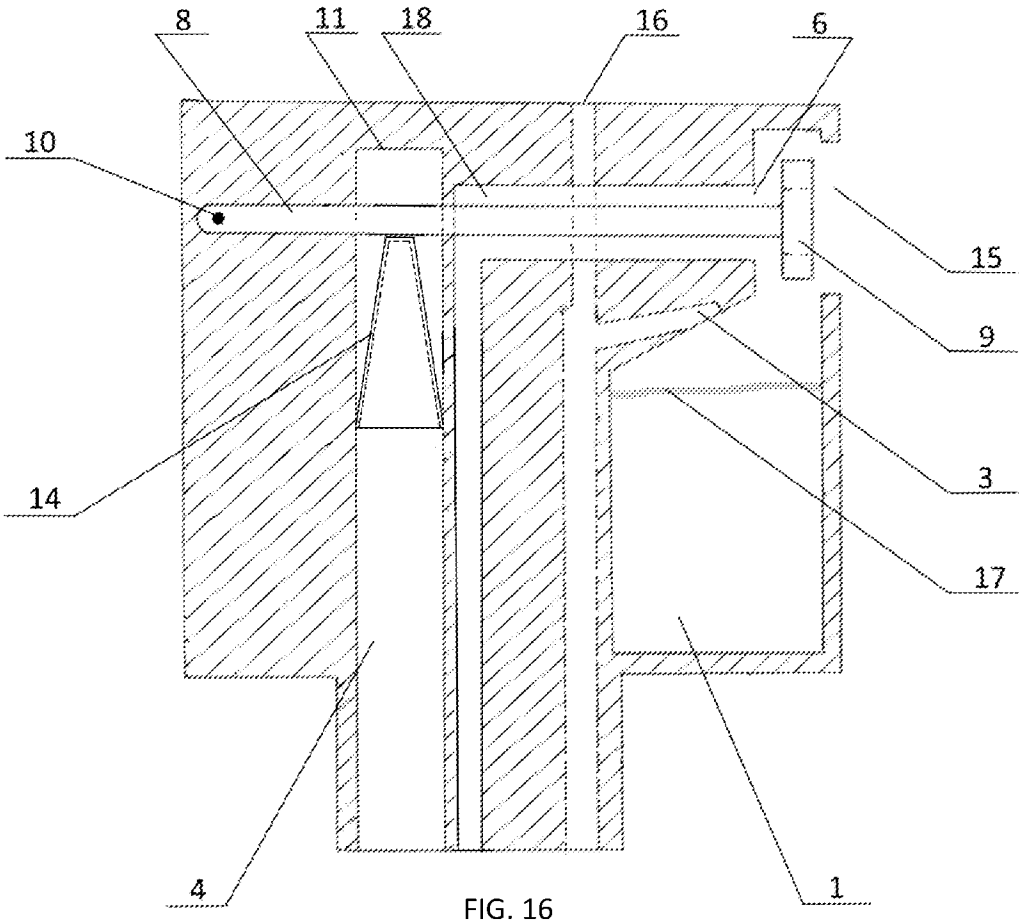
Figure 17:
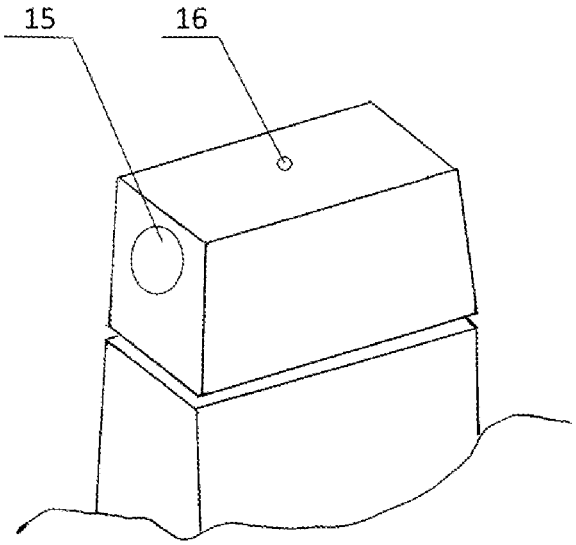
FIG. 17 represents an external view of any of the proposed embodiments of the cap together with the flexible container.

Thereat, guide 8, connected at one end with the fixed axis 10 and supported by membrane 14 in the operating condition is replacing from the inclined position to the horizontal one, such displacement being induced by guide 8 rotating counterclockwise relative to axis 10 and is bringing ring 9 to the position above soap level 17 and further until the ring 9 is aligned with nozzle 6 (FIG. 15, FIG. 16).

At the same time, affected by pressure increased by squeezing the flexible container, air is moving from the flexible container into the air outlet 18 to nozzle 6 thereto ring 9 with soap film is aligned. Under the pressure of the air supplied from the squeezed flexible container through air outlet 18, a soap bubble is blown out through ring 9 (FIG. 15, FIG. 16).

5. Stop squeezing the flexible container. Due to its elasticity it tends to regain its original shape, as a result of which the sub-membrane air volume is pulled into the flexible vessel, and membrane 14 also affected by gravity is advancing downwards along the air duct 4 and is coining to a sagging condition (similar to FIG. 14). As a result, while rotating clockwise relative to the axis 10 guide 8 comes from the horizontal position (FIG. 15, FIG. 16) to an inclined position, when the ring 9 is immersed into cavity 1 under the soap solution level 17—and the device returns to the "initial position".
6. Squeeze the flexible container by moving membrane 14 in the sub-membrane space by air pressure from the lowest—sagging-position to the highest position (FIG. 15, FIG. 16), and further affected by pressure in the sub-membrane space increased due to squeezing the flexible container, air flows from the flexible container into air outlet 18 to nozzle 6 thereto ring 9 with soap film is aligned. Under the pressure of the air supplied from the squeezed flexible container, a soap bubble is blown out through the ring 9 (FIG. 15, FIG. 16).

Having brought the device in the "initial position" (similar to FIG. 14) again, repeat the device operation steps 3-6 of the device operation sequence. While the device operation steps 3-6 are taken, soap solution is prepared in cavity 1 by mixing the shampoo with water when ring 9 is displaced. Repeat device operation steps 1-2 from time to time to replenish cavity 1 with soap solution.

Thus, the fourth embodiment of the proposed device according to claim 12 of the claimed invention is operated by periodically squeezing the flexible container.

In all embodiments of the device, additional shampoo dosing and dispensing devices may be integrated into the dispenser channel 3 and the shampoo delivery channel 2.

Thus, a soap bubble blowing device simple both in design and in operation has been developed in the form of a cap of a flexible container used for amusement in everyday life, for example, when bathing children; it is actuated with a piston (a flexible membrane) in the plug of the flexible container by manual squeezing the latter and with a simple lever system connected with piston (or with a flexible membrane), combining a bubble blowing ring with a nozzle hole when squeezing the flexible container and moving the ring into the soap solution after blowing a soap bubble and stopping squeezing. No compressed gas storage is required to operate the device.

The invention claimed is:

1. A soap bubble blowing cap configured to plug a flexible container containing a soap solution, the cap comprising:

a storage cavity positioned within the cap;

a channel for dispensing the soap solution from the flexible container into the storage cavity;

a nozzle;

an air duct having a wall with an opening; wherein the opening in the wall is configured to direct compressed air entering the air duct from a manual squeezing of the flexible container to the nozzle;

a piston, wherein the piston is installed in the air duct and is configured to be actuated by the compressed air entering the air duct from the manual squeezing of the flexible container;

a diaphragm ring;

a lever system, wherein the lever system is configured to connect the diaphragm ring to the piston such that the actuation of the piston causes the diaphragm ring to move between a position in which it is placed in the soap solution contained in the storage cavity and a position in which it is aligned with the nozzle.

2. The soap bubble blowing cap according to claim 1, wherein the lever system includes a guide rod, the diaphragm ring is fixed at one end of the guide rod and an axis within the cap is fixed to an opposite end of the guide rod, the wall of the air duct further includes a groove, and the piston further includes aligned upper and lower piston movement limiters installed on an outer surface of the piston, the aligned upper and lower piston movement limiters are configured to be positioned within the groove such that the guide rod rotates about the axis within limits determined by a distance between the aligned upper and lower piston movement limiters.

3. The soap bubble blowing cap according to claim 1, wherein the cap is additionally equipped with a dispenser channel configured to directly deliver the soap solution from the flexible container to an exterior of the cap for hygienic procedures.

4. The soap bubble blowing cap configured to plug a flexible container containing a soap solution, the cap comprising:

a storage cavity within the cap;

a channel for dispensing the soap solution from the flexible container into the storage cavity;

an air duct having a wall;

a piston, wherein the piston is installed in the air duct and is configured to be actuated by compressed air entering the air duct from manual squeezing of the flexible container;

a nozzle;

an L-shaped air outlet, wherein the L-shaped air outlet is configured to direct the compressed air entering the air outlet from the manual squeezing of the flexible container to the nozzle;

a diaphragm ring;

a lever system, wherein the lever system is configured to connect the diaphragm ring to the piston such that the actuation of the piston causes the diaphragm ring to move between a position in which it is placed in the soap solution contained in the storage cavity and a position in which it is aligned with the nozzle.

5. The soap bubble blowing cap according to claim 4, wherein the lever system includes a guide rod, the diaphragm ring is fixed at one end of the guide rod and an axis within the cap is fixed to an opposite end of the guide rod, the wall of the air duct further includes a groove, and the piston further includes aligned upper and lower piston movement limiters installed on an outer surface of the piston, the aligned upper and lower piston movement limiters are configured to be positioned within the groove such that the guide rod rotates about the axis within limits determined by a distance between the aligned upper and lower piston movement limiters.

6. The soap bubble blowing cap according to claim 4, wherein the cap is additionally equipped with a dispenser channel configured to directly deliver the soap solution from the flexible container to an exterior of the cap for hygienic procedures.

7. A soap bubble blowing cap configured to plug a flexible container containing a soap solution, the cap comprising:

a storage cavity positioned within the cap;

a channel for dispensing the soap solution from the flexible container into the storage cavity;

a nozzle;

an air duct having a wall defining a cross-section and an opening in the wall, wherein the opening in the wall is configured to direct compressed air entering the air duct from manual squeezing of the flexible container to the nozzle;

a flexible membrane, wherein the flexible membrane is installed in the air duct to overlap the cross-section and is configured to be actuated by the compressed air entering the air duct from the manual squeezing of the flexible container;

a diaphragm ring; and a lever system, wherein the lever system is configured such that actuation of the flexible membrane drives the lever system to move the diaphragm ring between a position in which it is placed in the soap solution contained in the storage cavity and a position in which it is aligned with the nozzle.

8. The soap bubble blowing cap according to claim 7, wherein the lever system includes a guide rod, the diaphragm ring is fixed at one end of the guide rod and an axis within the cap is fixed to an opposite end of the guide rod, wherein the guide rod rotates about the axis induced by the manual squeezing of the flexible container.

9. The soap bubble blowing cap according to claim 7, wherein the cap is additionally equipped with a dispenser channel configured to directly deliver the soap solution from the flexible container to an exterior of the cap for hygienic procedures.

10. A soap bubble blowing cap configured to plug a flexible container containing a soap solution, the cap comprising:

a storage cavity positioned within the cap;

a channel for dispensing the soap solution from the flexible container into the storage cavity;

an air duct having a wall defining a cross-section;

a flexible membrane, wherein the flexible membrane is installed in the air duct to overlap the cross-section and is configured to be actuated by compressed air entering the air duct from manual squeezing of the flexible container;

a nozzle;

an L-shaped air outlet, wherein the L-shaped air outlet is configured to direct the compressed air entering the air outlet from the manual squeezing of the flexible container to the nozzle;

a diaphragm ring; and a lever system, wherein the lever system is configured such that the actuation of the flexible membrane drives the lever system to move the diaphragm ring between a position in which it is placed in the soap solution contained in the storage cavity and a position in which it is aligned with the nozzle.

11. The soap bubble blowing cap according to claim 10, wherein the lever system includes a guide rod, the diaphragm ring is fixed at one end of the guide rod and an axis within the cap is fixed to an opposite end of the guide rod, wherein the guide rod rotates about the axis induced by the manual squeezing of the flexible container.

12. The soap bubble blowing cap according to claim 10, wherein the cap is additionally equipped with a dispenser channel configured to directly deliver the soap solution from the flexible container to an exterior of the cap for hygienic procedures.

* * * * *